US005261866A

United States Patent [19]

Mattox

[11] Patent Number: 5,261,866

[45] Date of Patent: Nov. 16, 1993

[54] WHEELED EXERCISE DEVICE

[76] Inventor: Ernest M. Mattox, 1640 Leonard, N.W., Grand Rapids, Mich: 49504

[21] Appl. No.: 746,905

[22] Filed: Aug. 19, 1991

[51] Int. Cl.[5] ..... A63B 21/00

[52] U.S. Cl. ..... 482/125; 482/132; 482/139

[58] Field of Search ..... 482/121, 122, 123, 125, 482/131, 132, 139, 49

[56] References Cited

U.S. PATENT DOCUMENTS

| | | | |
|---|---|---|---|
| 3,584,871 | 6/1971 | Kelmon, Jr. | 482/132 |
| 3,664,667 | 5/1972 | McCarthy | 482/131 X |
| 3,895,795 | 7/1975 | Merz | 482/132 X |
| 4,059,265 | 11/1977 | Wieder et al. | 482/129 X |
| 4,132,404 | 1/1979 | Wilson | 482/132 |

FOREIGN PATENT DOCUMENTS

| | | | |
|---|---|---|---|
| 634093 | 12/1937 | Fed. Rep. of Germany | 482/132 |
| 126662 | 11/1949 | Sweden | 482/132 |

*Primary Examiner*—Gene Mancene
*Assistant Examiner*—L. Thomas
*Attorney, Agent, or Firm*—Varnum, Riddering, Schmidt & Howlett

[57] ABSTRACT

An improved wheeled exercise device which is adjustable for users of different size and muscle capability. The device comprises a wheel rotatably mounted on an axle, a pair of handgrips telescopically mounted on the axle, and a length of elastic tubing telescopically mounted on the opposite ends of the axle. A pair of pads are adjustably mounted on the elastic tubing. The pads may be moved to different points along the length of the tubing to accommodate users of different size and strength. The user kneels or stands on the pads, grips the handgrips, and rolls the wheel and axle forward, away from the pads until the user is in the prone position. Thereafter, the user rolls the axle and wheel backward, until the starting position is reached.

26 Claims, 7 Drawing Sheets

WHEELED EXERCISE DEVICE

BACKGROUND OF THE INVENTION

1. Field of the Invention

This invention relates to a wheeled exercise device and, more particularly, to a wheeled exercise device with elastic resistance members. In one of its aspects, the invention relates to a wheeled exercise device with elastic resistance members having adjustable pads for varying the device for users of different size and muscle capability.

2. Description of Related Art

There are numerous exercises which an individual may practice to strengthen muscles and maintain muscle tone. The Royal Canadian Air Force has a well-known exercise regiment with several different exercises required. One of the exercises of this regiment requires a person to start in a kneeling position on his hands and knees, then push his body forward, sliding out along his hands with his arms rigid. The exerciser continues pushing forward until his body is in the prone position with his arms extended out beyond his head and shoulders and his hips lowered to the floor. Then, the exerciser returns to the kneeling position by reversing the sliding action. As one can imagine, this is a very difficult exercise especially for an individual who is not in good physical condition.

The movement of the exercise described above is beneficial for the exerciser's arms, shoulders, back and abdominal muscles. In light of this, others have created exercise devices which assist the exerciser in completing the kneeling-prone-kneeling movement through the user of a biased, wheeled exercise device. For example, the German Patent Applications No. 2,029,451 to Neubert published Dec. 2, 1971 and No. 2,017,216 to Buchmann published Oct. 28, 1971 disclose wheeled exercise devices which assist the exerciser in the kneeling-prone-kneeling movement described above. In each of these references, the user grasps an axle which rotatably supports one or more wheels. The user hooks his or her feet into stirrups which are connected to the axle by one or more springs or pieces of elastic. The user can push forward from a kneeling position to the prone position by rolling the wheel away from his knees. This movement is resisted by the springs which extend between the wheel and the user's feet.

Another modification of this device is seen in U.S. Pat. No. 1,984,165 to Tolchin issued Dec. 11, 1934. The device of Tolchin incorporates a pair of fixed knee pads which are mounted adjacent a guide rail upon which a trolley rides The user kneels on the pads, grasps the handle bars of the trolley and extends forward from the kneeling to the prone position and returns to the kneeling position. A compression spring biases the trolley toward the knee pads.

A further modification of such a device is seen in U.S. Pat. No. 3,752,475 to Ott issued Aug. 14, 1973. Ott describes a wheel rotatably mounted on an axle with a spring or other bias means mounted between the wheel and axle which resists rotation of the wheel relative to the axle. Therefore, as the user grasps the axle and rolls the device forward, the rotation of the wheel is resisted by the spring bias.

Unfortunately, the exercise devices described above have two significant drawbacks. First, the Neubert, Buchmann, and Ott devices provide no padding for the user's knees. Therefore, use of the device even on a padded or carpeted floor is quite painful for the user's knees. While the Tolchin apparatus does disclose pads for the knees, these pads are fixed with respect to the moving trolley. Therefore, there is no adjustability for the knee pads, thereby limiting the usefulness of the device for persons of different size and condition.

Second, and perhaps more importantly, each of the devices discussed above incorporate hooks, straps, stirrups and other attachment means which could easily injure the user. For example, if the user is extended to the fully prone position, the springs of the various devices will be stretched a large amount and exert a large amount of force on the hooks and connections between the springs and the connection to the axle and stirrups. If one of these connections or hooks were to fail under this load, both the failed hook and the spring would become projectiles and could injure the user. Therefore, the elimination of these hooks and interconnections enhances the safety of the product.

SUMMARY OF INVENTION

The wheeled exercise device according to the invention overcomes the problems of the prior art devices by incorporating adjustable knee pads and by making the device safer through the elimination of hooks and stirrups as seen in the prior art.

The invention relates to an improved wheeled exercise device comprising at least one wheel, an axle rotatably mounted on the wheel, a pair of handgrips mounted on the axle, a first and second elastic member, each of which is mounted at one end to the axle, and at least one pad for the user to position his or her knees or feet. The pad is adjustably mounted on the first and second elastic members for selectively restricting movement of the elastic member with respect to the pad. In operation, the user grips the handgrips, positions his or her knees or feet on the pad and pushes the wheel and axle away from the pad to stretch the elastic members. The pad may be positioned at different points along the tubing to adjust the device for users of different size and different muscle capability.

In the preferred embodiment, the first and second elastic members are joined together at their second ends remote from the axle. Preferably, the one ends of the first and second elastic members are telescopically mounted on the axle.

In another embodiment, a first pad is telescopically mounted on the first elastic member and a second pad is telescopically mounted on the second elastic member. Preferably, the elastic members are made of latex tubing.

In a further embodiment, the pad comprises a lower member and an upper member which are interconnected by at least one hinge. The first and second elastic members pass through a channel between the upper and lower members. Movement of the elastic members is selectively restricted with respect to the pad when the user positions his or her knees or feet on the upper member. Preferably, the upper member is padded.

In yet a further embodiment, the pad comprises a lower member and an upper member which are interconnected by at least one threaded screw. The screw is threadably mounted in both the upper and lower members to clamp the first and second elastic members which pass through a channel between the lower and upper members. Movement of the elastic members with respect to the pad is selectively restricted by rotation of the threaded screw.

In an another embodiment, the pad comprises an upper member which is merely placed on top of the elastic members and selectively clamps the elastic member between the upper member and the ground on which the user is exercising. The user stands or kneels on the upper member to restrict movement of the elastic member with respect to the pad.

In yet a further embodiment, the elastic members have a set of graduations mounted thereon to assist the user in use of the exercise device.

A further embodiment of the exercise device comprises at least one wheel, an axle with the wheel rotatably mounted thereon, a first and second elastic member fixedly attached to the axle, and a set of graduations mounted on the first and second elastic members. The graduations are an indicator for the user to position his or her knees or feet on the elastic members. The weight of the user on the first and second elastic members selectively restricts movement of the elastic members with respect to the user's knees or feet. The user grips the handgrips, positions his or her knees or feet on the graduations and pushes the wheel and axle away from his or her knees or feet to stretch the elastic members. The user's position of his or her knees or feet at different graduations on the elastic members accommodates users of different size and muscle capability. Preferably, the first and second elastic members are mounted in a diametrical slot within the axle.

In another embodiment, the first and second elastic members are mounted on opposite sides of the wheel on the axle.

BRIEF DESCRIPTION OF THE DRAWINGS

The invention will now be described with reference to the drawings wherein.

DESCRIPTION OF THE PREFERRED EMBODIMENT

Figure 1:
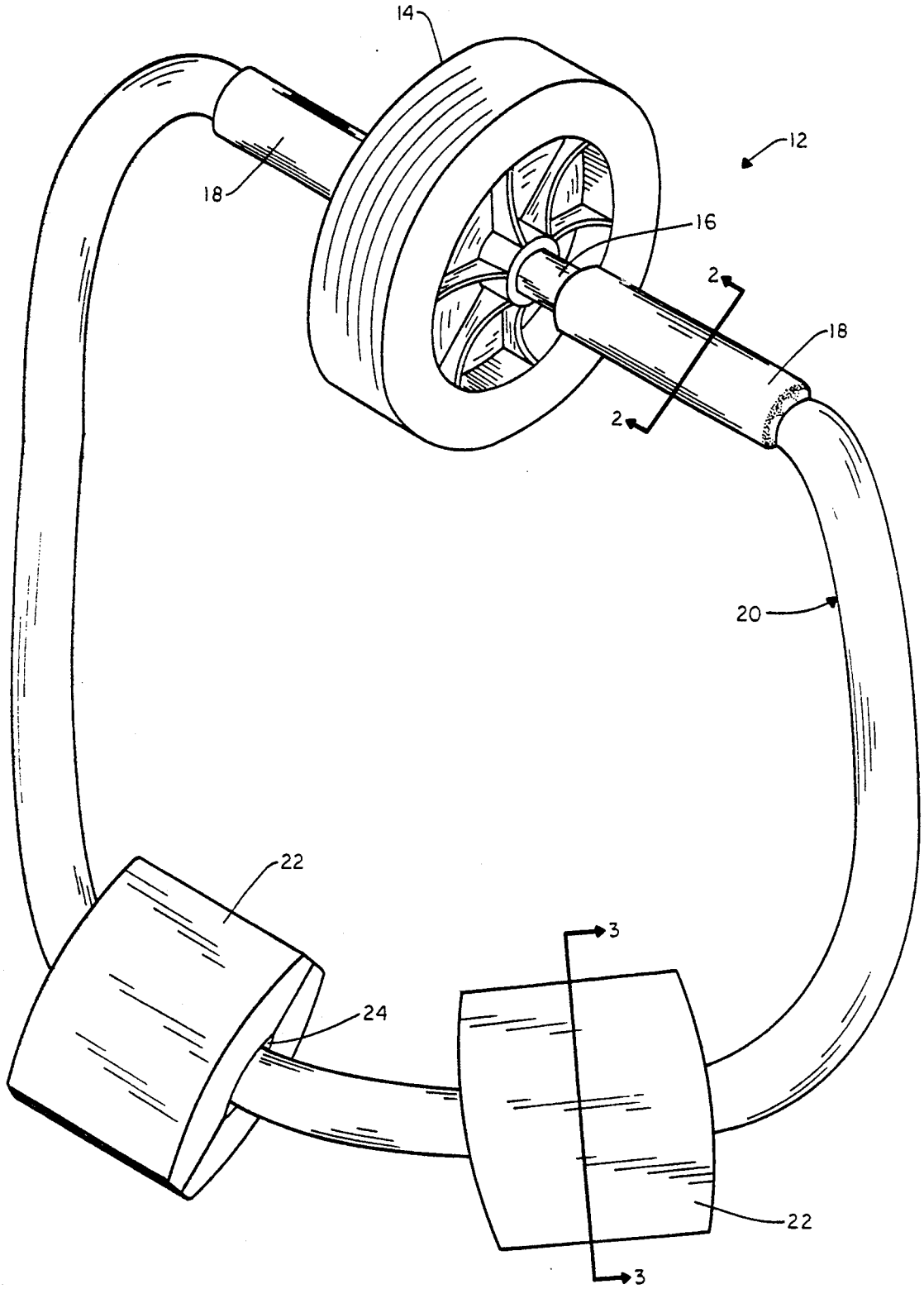
FIG. 1 is a perspective view of a first embodiment of the wheeled exercise device according to the invention.

Referring now to the drawings and to FIG. 1 in particular, a wheeled exercise device 12 comprises a wheel 14, an axle 16 a pair of handgrips 18, a length of elastic tubing 20 and a pair of adjustably mounted pads 22. The wheel 14 is rotatably mounted on the axle 16. The ends of the elastic tubing 20 are telescopically mounted on the ends of the axle 16. Handgrips 18 are telescopically mounted on the elastic tubing 20 which is mounted on the axle 16. The pads 22 have a channel 24 through which the elastic tubing 20 passes.

Preferably, the elastic tubing 20 is hollow latex tubing with an internal diameter less than the outer diameter of the axle 16. One end of the tubing 20 is telescopically mounted on the axle 16 by lubricating the axle with an agent which will quickly evaporate so that the tubing 20 may not be easily removed from the axle 16 once it is mounted thereon. The preferred agent for mounting the tubing 20 on the axle 16 is rubbing alcohol. The alcohol quickly evaporates after the tubing 20 is mounted on the axle 16, it leaves no residue and, when used in limited amounts, will not affect the properties of the tubing 20.

Figure 2:
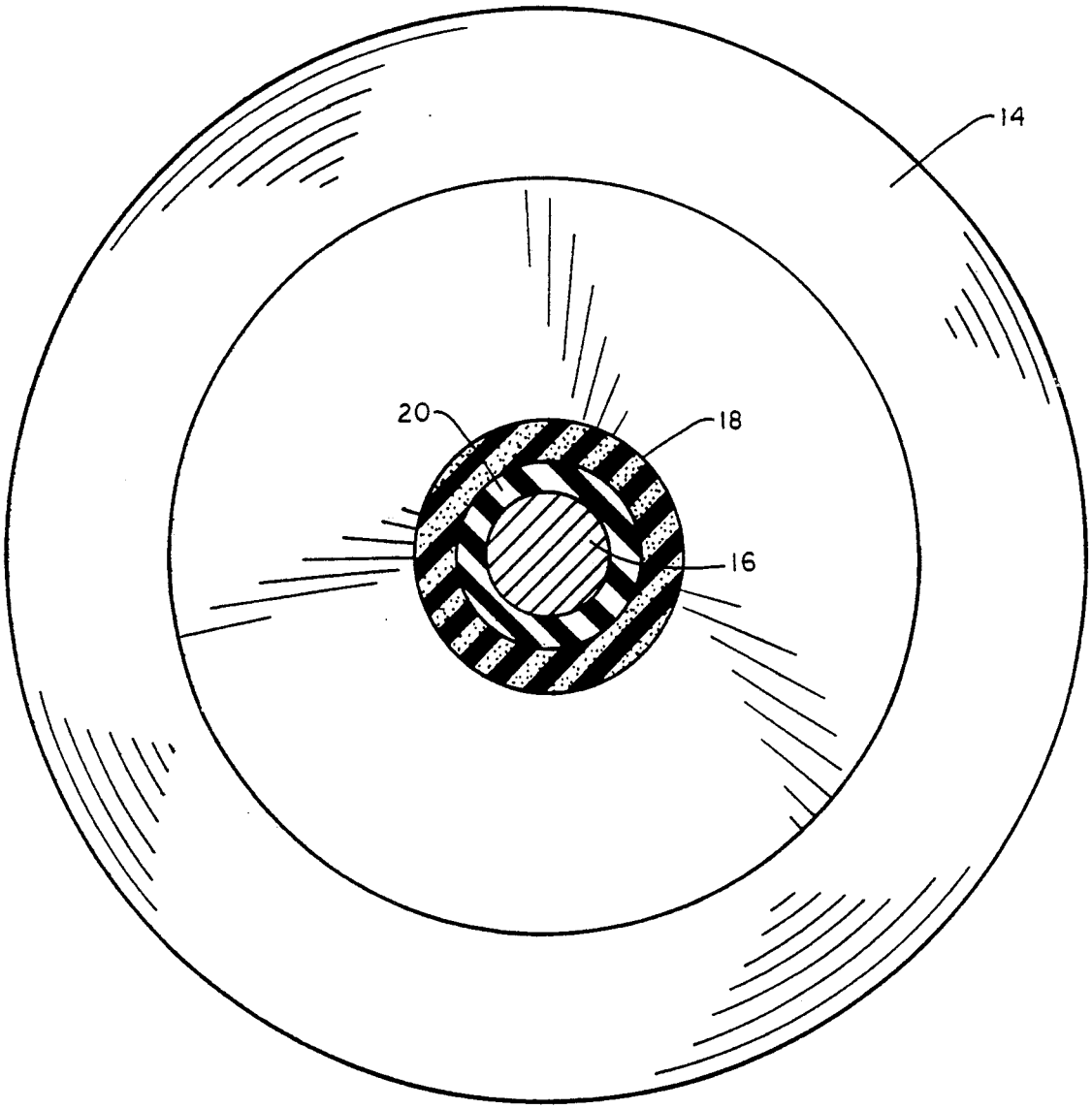
FIG. 2 is a cross-sectional view of the axle of the exercise device taken along lines 2—2 of FIG. 1.

As seen in FIG. 2, the handgrips 18 are telescopically mounted on the axle 16 and the tubing 20 mounted thereon. Preferably, the handgrips 18 are a soft sponge or foam rubber which provides a comfortable grip for the user and can absorb the user's perspiration which may otherwise cause slipping of the user's grip on the device.

Figure 3:
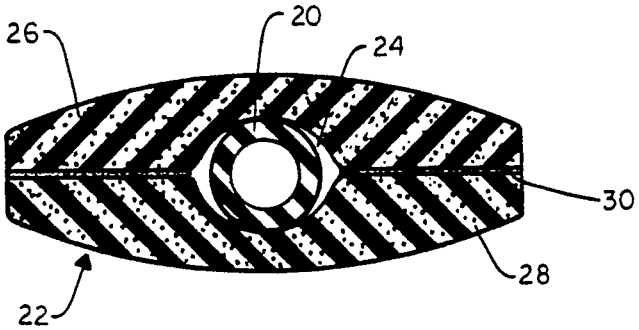
FIG. 3 is a cross-sectional view of the adjustable knee pad of the first embodiment of the invention taken along lines 3—3 of FIG. 1.

Telescopically mounting the tubing 20 on the ends of the axle 16 provides several benefits for the exercise device 12. First, by mounting the elastic tubing 20 telescopically, no hooks, fasteners or other mechanical fastening devices are necessary, thereby making the device safer. Failure of a hook or other mechanical fastener during use of the exercise device could easily injure the user. Secondly, mounting the tubing 20 telescopically on the axle 16 provides stability for the exercise device. By increasing the distance between the points of loading on the axle 16, the wheeled exercise device 12 is more stable, less likely to tip from side to side. A pair of adjustably mounted pads 22 are telescopically mounted on the tubing 20. As seen in FIG. 3, the tubing 20 passes through a channel 24 in the pads 22. Preferably, the pads comprise a pair of square sheets of soft foam rubber 26 and 28 which are attached to one another by an adhesive coating 30. The adhesive 30 is applied in two parallel bands, thereby creating the channel 24 therebetween. Alternatively, the pads 22 can be molded as an integral part with a channel mounted therein. Preferably the pads 22 are large enough to provide padding for the user's entire knee and to create a stable surface to kneel upon.

For the ease of describing the invention, the user will be referred to herein in the masculine gender, although it is to be understood that the apparatus is equally useful for both men and women.

As seen in FIGS. 4–7, a user 36 begins the exercise by kneeling on pads 22 and by grasping the handgrips 18 on either side of the wheel 14. The weight of the user 36 on the pads 22 pinches or clamps the tubing 20 within the channel 24 of the pads 22. This clamping prevents movement of the elastic tubing 20 relative to the pads 22.

Figure 5:
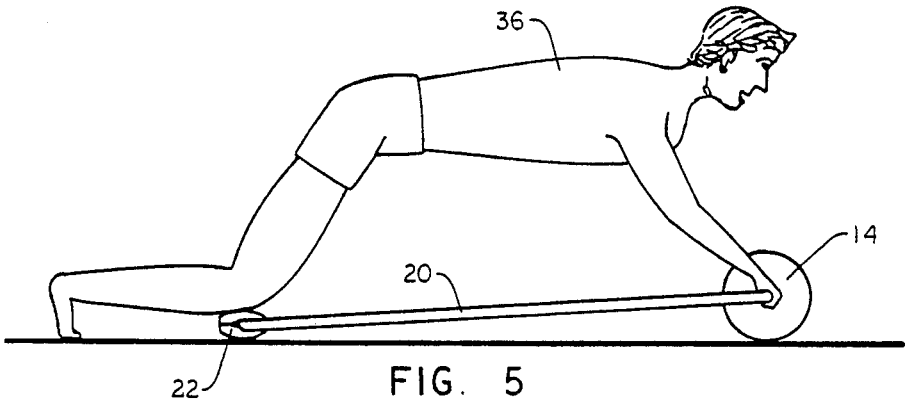
FIG. 5 is a side elevational view of a user as he or she begins to push the wheel and axle forward.
Figure 6:
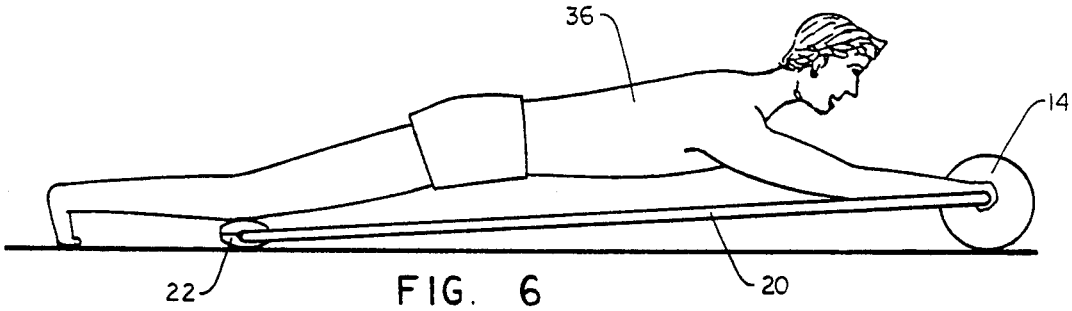
FIG. 6 is a side elevational view of an individual using the device in the prone, fully extended position.
Figure 7:
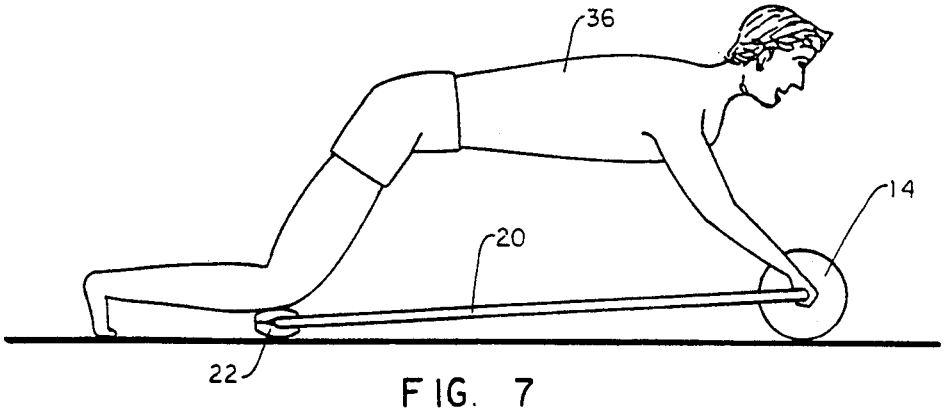
FIG. 7 is a side elevational view of an individual using the device as he or she returns from the prone position to the initial kneeling position.

The exercise begins by the user 36 rolling the wheel 14 and axle 16 forward away from his knees, as seen in FIG. 5. This rolling motion is resisted by the elasticity of the tubing 20. The user 36 has completed the first half of the exercise when he reaches the fully extended or prone position, as seen in FIG. 6. As seen in FIG. 7, the user 36 completes the exercise by rolling the wheel backwards, returning from the fully prone position to the kneeling position. The user 36 is assisted in returning to the kneeling position by the elasticity of the tubing 20.

Figure 8:
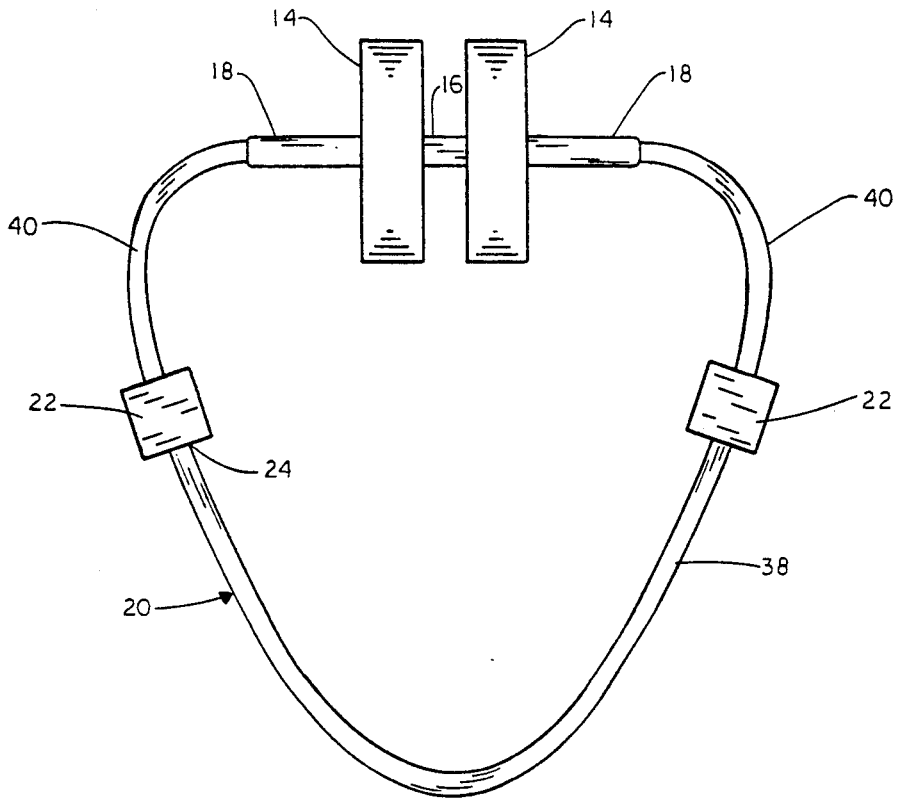
FIG. 8 is a top plan view of a two-wheeled exercise device with the pads adjusted for either a shorter user or a beginner to the exercise.

As seen in FIG. 8, the wheeled exercise device 12 can incorporate more than one wheel 14. The mounting of the handgrips 18 relative to the wheels 14 can also be varied. For example, the wheels can be separated a sufficient distance such that handgrips can be mounted between the wheels 14. Alternatively, the axle 16 can be of a length sufficient to accommodate handgrips 18 on the outside of the two wheels 14, and between the two wheels 14, thereby providing greater variability for the use of the device.

Figure 4:
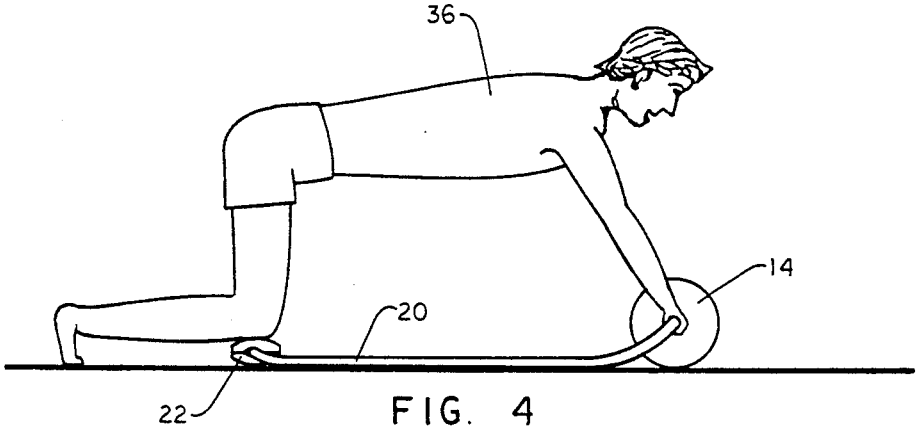
FIG. 4 is a side elevational view of an individual using the exercise device in the initial, kneeling position.
Figure 9:
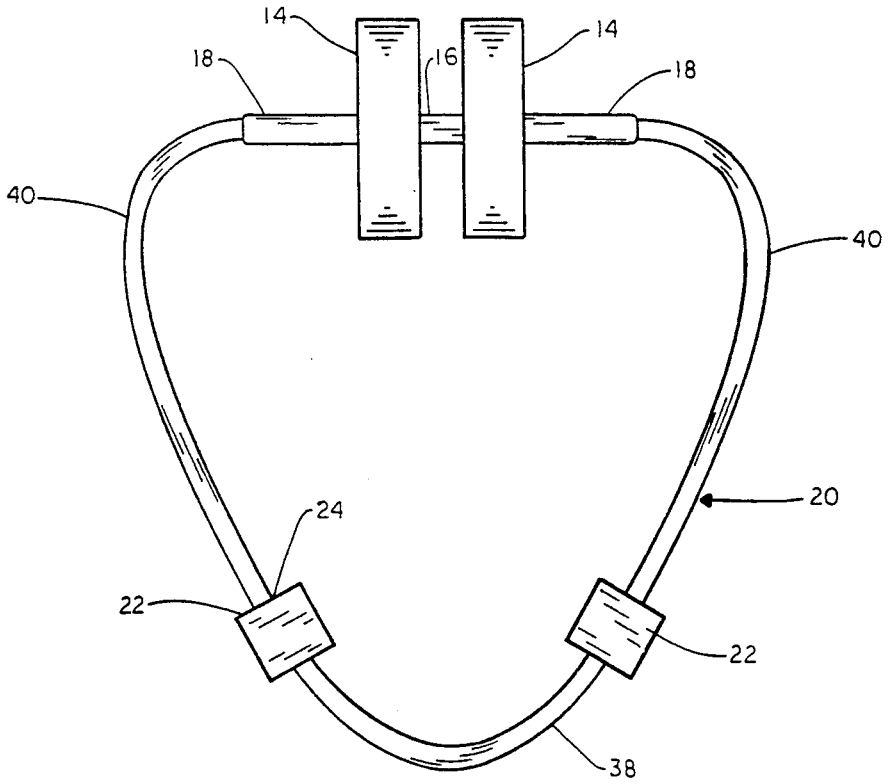
FIG. 9 is a top plan view of the two-wheeled device as seen in FIG. 8 with the pads adjusted for a taller, or more advanced user of the device.

FIGS. 8 and 9 disclose how movement of the adjustable pads 22 also varies the exercise device 12. As seen in FIG. 8, the elastic tubing 20 comprises an intermediate portion 38, and pair of active portions 40. As discussed above, the user kneels on the pads 22 and thereby clamps the tubing 20 between the pads 22. The clamping is effective to restrict movement of the elastic tubing 20 relative to the pads 22. Therefore, as the user moves from the kneeling to the prone position, as seen in FIGS. 4–6, it is only the active portions 40 of the tubing 20, i.e. the portion of the tubing 20 between the pads 22 and the axle 16, which are stretched and provide resistance for the exercise. The intermediate portion 38 is not stretched and therefore remains in the relaxed state because it lies between the two clamping pads 22.

The most difficult portion of the exercise for the user 36 is the when the user is in the fully extended or prone position. At this point in time, the user's arms, shoulders, back and abdominal muscles are under the greatest strain. The elastic tubing 20 provides a return force helping the user 36 to exit the prone position and return to the kneeling position. Therefore, for individuals who are not conditioned for this exercise, it is desirable that a greater amount of return force be supplied by the elastic tubing 20 to help the user 36 out of the prone position. For a person who is strong and in good physical condition, less return force from the elastic tubing 20 would be desired, so that the user would need to exert more force to raise himself from the fully prone position. It can be easily understood that by varying the length of the portion of the elastic tubing 20 which is stretched, i.e. the active portion 40 that the return force supplied by the tubing 20 also varies. The wheeled exercise device 12 according to the invention permits the adjustability of the pads 22 along the length of the tubing 20. This varies the length of the active portions 40 of the tubing and therefore varies the return force supplied by the tubing.

FIGS. 8 and 9 depict the adjustability of the pads 22. As seen in FIG. 8, the length of the active portion 40 of the tubing 20 is short in comparison to the length of the intermediate portion 38. Therefore, the length of tubing 20 which is stretched as the user moves from the kneeling to the prone position is relatively short. Because the relatively short length of tubing 40 must be stretched a relatively long distance, a greater amount of return force is supplied by the active portions 40. A beginner or person not in good muscular condition would adjust the pads 22 such that the active portion 40 are relatively short, as seen in FIG. 8. This orientation provides a greater amount of return force when the user is in the most strenuous portion of the exercise as seen in FIG. 6. The relatively shorter length active portion 40 requires the user to exert a greater amount of force to reach the prone position. However, this action is not the more difficult portion of the exercise.

A user in better physical condition would adjust the pads 22 further away from the axle 16, as seen in FIG. 9. In this position, the active portions 40 comprise a greater length of tubing 20 than that seen in FIG. 8, consequently, the intermediate portion 38 is significantly shorter. Therefore, as the user rolls the device forward from the kneeling position, as seen in FIG. 4, to the prone position, as seen in FIG. 6, a lesser amount of return force is supplied by the tubing 20 to assist the user out of the prone position. Therefore, the user would need greater physical strength to lift himself from the prone position.

The pads 22 may be easily adjusted to an infinite number of positions along the length of tubing 20 thereby permitting the user to progress from a beginning position, as seen in FIG. 8, to a more advanced position as seen in FIG. 9, and all other points along the length of tubing 20.

The adjustability of the pads 22 also permits use of the device 12 by differently sized users. For example, a person who is extremely tall will stretch the elastic tubing 20 farther than a shorter user when moving from the kneeling to the prone position. In order for a short user and a tall user to experience the same amount of resistance by the tubing 20, the taller user may need to move the adjustable pads 22 further away from the axle 16 compared to the shorter user.

The adjustability of the pads 22 also allows the user to vary the spacing between his knees. For example, one user might find it more comfortable to have his knees close together as he performs the exercise. A different user may find it more comfortable to space his knees apart for greater stability as he performs the exercise. The incorporation of the flexible elastic tubing 20 and the adjustable pads 22 permits the user to easily adjust the spacing between his knees without affecting the exercise or the resistance supplied by the tubing.

Figure 10:
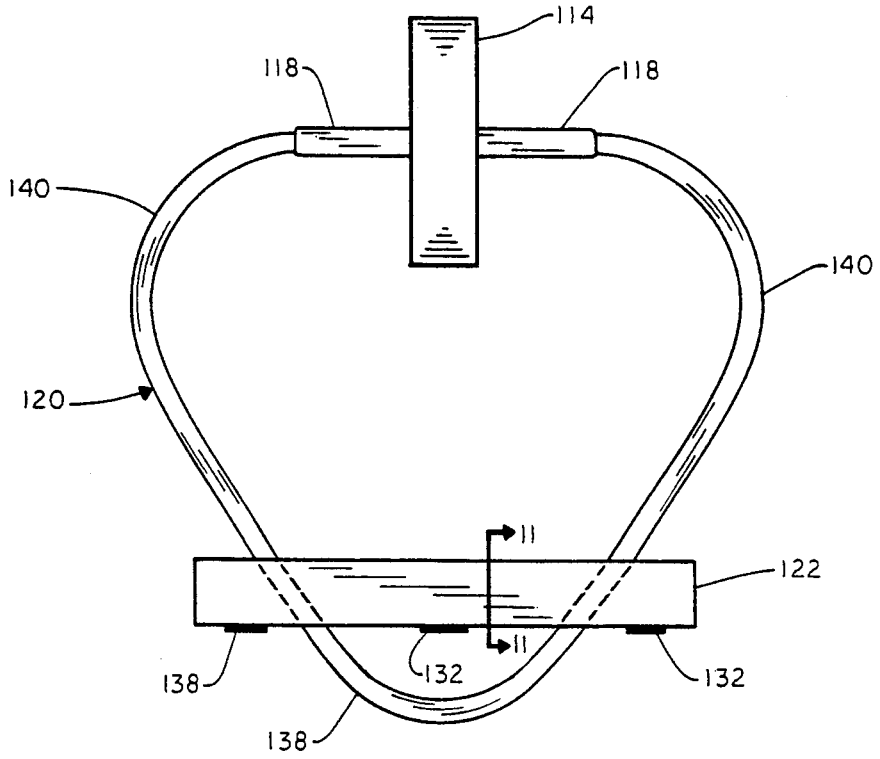
FIG. 10 is a top plan view of a second embodiment of the exercise device.
Figure 11:
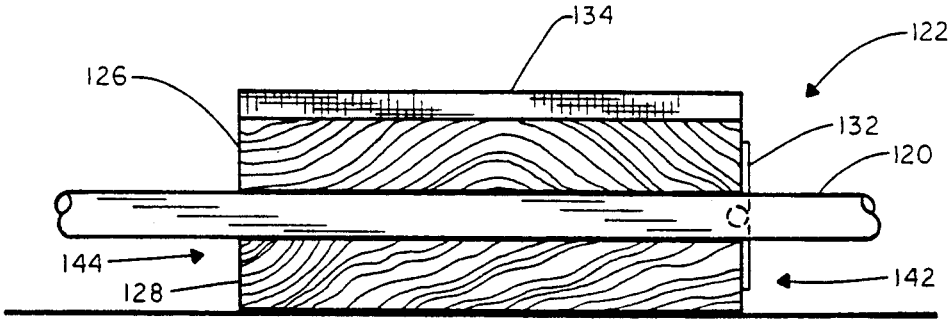
FIG. 11 is a cross-sectional view of the second embodiment of the device taken along lines 11—11 of FIG. 10.

FIGS. 10 and 11 show a second embodiment of the exercise device according to the invention. In the discussion of the second embodiment, reference numerals analogous to the first embodiment will be increased by 100.

As seen in FIG. 10, the wheeled exercise device 112 comprises a wheel 114, an axle (not shown) handgrips 118, a length of elastic tubing 120, and a pad 122. As seen in FIG. 11, the pad comprises an upper member 126 and a lower member 128. A channel 124 is created between the upper and lower members 126 and 128. The tubing 120 passes through this channel. The upper and lower members, 126 and 128, are interconnected by one or more hinges 132 along a trailing edge 142 of the pad. Preferably the upper and lower members, 126 and 128, are wood which receives suitable screws (not shown) to mount the hinges 132 thereto. Preferably, padding 134 is mounted on the upper surface of upper member 126 to cushion the user's knees.

In use, the user positions the pad 122 at the desired location along the length of tubing such that the desired active portion 140 of the tubing will be stretched. Then, the user kneels on the pad 122. In light of the hinged interconnection along the trailing edge 142 of the pad 22, the tubing 20 is clamped between the upper and lower members, 126 and 128, at a leading edge 144 of the pad 22. Once the tubing 20 is clamped, only the active portions 140 are stretched during the exercise and the tubing 120 cannot move relative to the pad 122.

The second embodiment can be further simplified. Rather than clamping the tubing 120 between the upper member 126 and the lower member 128, it is possible to eliminate the lower member 128 and the hinges 132 and merely clamp the tubing 120 between the upper member 126 and the ground or surface upon which the user is exercising. In operation, the user would place the upper member 126 on top of the tubing 120 at the desired position, and then position his knees on top of the upper member 126, thereby clamping the tubing 120 between the ground and the upper member 126. The weight of the user would be sufficient to clamp the tubing 120 to restrict movement of the tubing relative to the upper member 126 of the pad 122.

Figure 12:
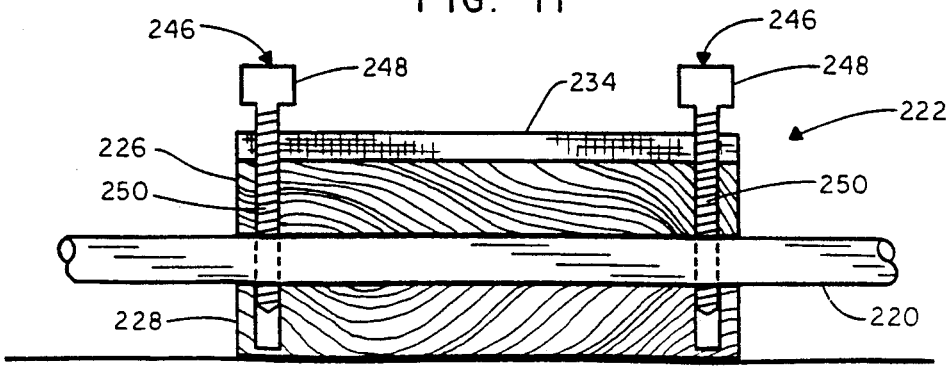
FIG. 12 is a cross-sectional view of a third embodiment of the device similar to the view of FIG. 11.

FIG. 12 shows a third embodiment of the device according the to invention. In the description of the third embodiment, reference numerals analogous to the first embodiment are increased by 200.

In the third embodiment, the pad 222 comprises an upper member 226 and a lower member 228. The upper and lower members, 226 and 228, are interconnected by a plurality of adjustment screws 246. The adjustment screws comprise a head 248 and a threaded shank 250. The shank 250 is threadably mounted in both the upper member 226 and the lower member 228. Rotation of the adjustment screw 246 will cause adjustment of the upper member 226 relative to the lower member 228, thereby either clamping the elastic tubing 220 within the channel 224 between the upper and lower members, 226 and 228, or releasing the tubing 220.

In operation, the user would loosen the screws 246 until the tubing 220 moves freely through the channel 224. The user would adjust the pad 222 to the appropriate position, and then tighten the adjustment screws 246 to clamp the tubing 222 between the upper and lower members, 226 and 228. Thereafter, the user would kneel on the padding 234 mounted on top of the upper member 226 and complete the exercise.

Figure 13:
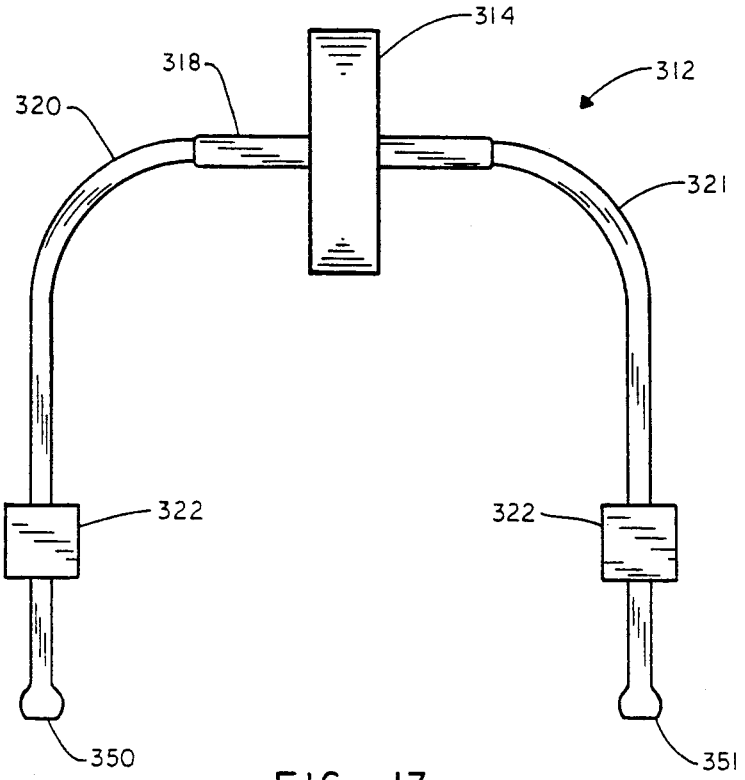
FIG. 13 is a top plan view of a fourth embodiment of the exercise device wherein two lengths of elastic tubing are incorporated.

A fourth embodiment of the wheeled exercise device is shown in FIG. 13. In FIG. 13, reference numerals analogous to the first embodiment are increased by 300.

The fourth embodiment of the wheeled exercise device 312 comprises a wheel 314, an axle (not shown), handgrips 318, and adjustable pads 322. In this embodiment, a first length of tubing 320 and a second length of tubing 321 are utilized rather than a single length of tubing as described above. One end of the first and second lengths of tubing, 320 and 321, are telescopically mounted on the opposite ends of axle (not shown). An adjustable pad 322 is telescopically mounted on each of the lengths of tubing, 320 and 321. The second ends of the lengths of tubing, 320 and 321, have a plug, 350 and 351, attached thereto, respectively. The plugs, 350 and 351, serve to retain the pads 322 on the lengths of tubing, 320 and 321.

In operation of the fourth embodiment of the wheeled exercise device 312, the user adjusts the pads 322 along the lengths of tubing, 320 and 321, to the desired position. Thereafter, the user kneels on the pads 322, thereby clamping the lengths of tubing, 320 and 321, within the channel 324 of the pads 322. Finally, the user rolls the wheel 314 forward and backward against the resistance supplied by the lengths of tubing, 320 and 321.

Figure 14:
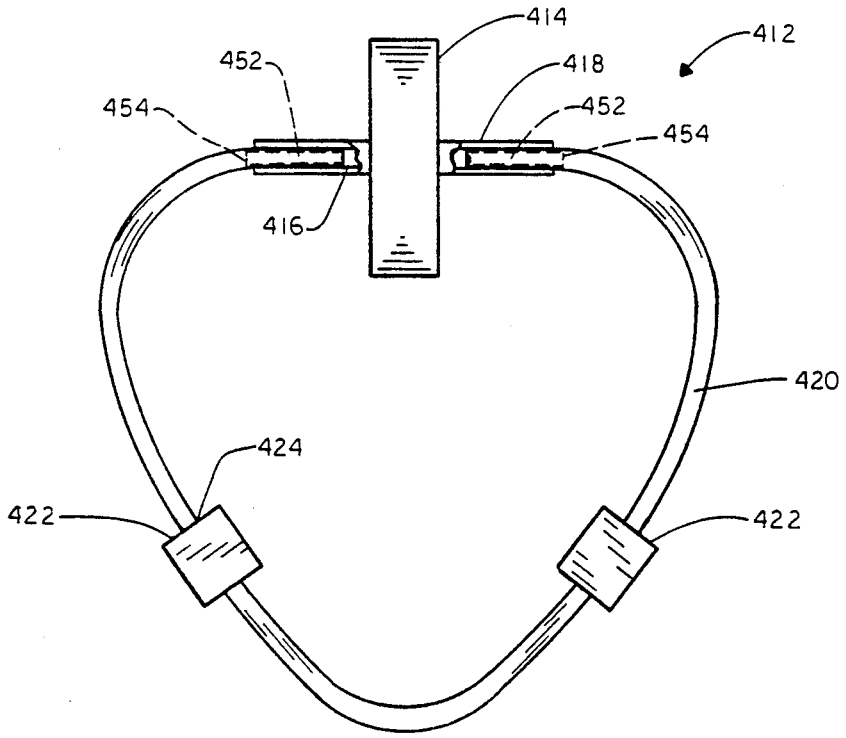
FIG. 14 is a top plan view of a fifth embodiment of the exercise device.

FIG. 14 depicts a fifth embodiment of the wheeled exercise device. In this description, reference numerals analogous to the first embodiment are increased by 400.

The fifth embodiment of the wheeled exercise device 412 comprises a wheel 414, a hollow axle 416, handgrips 418, a length of elastic tubing 420, and a pair of adjustable pads 422. The tubing 420 passes through a channel (not shown) in the pads 422 and therefore the pads 422 are telescopically mounted thereon.

In the fifth embodiment of the wheeled exercise device 412, a pair of end members 452 are mounted to the ends of the tubing 420. Preferably, the end members are wooden dowels. The ends of the tubing 420 concentrically receive the end members 452. The end members 452 are then concentrically mounted within the hollow ends of the axle 416. Preferably, a distal end 454 of the end members 452 extend beyond the terminal ends of the axle 416.

In operation, the user adjusts the pads 422 to the desired position, kneels on the pads 422, thereby clamping the tubing 420, then grasps the handgrips 418 and pushes the wheel forward and back against the resistance supplied by the tubing 420.

Figure 15:
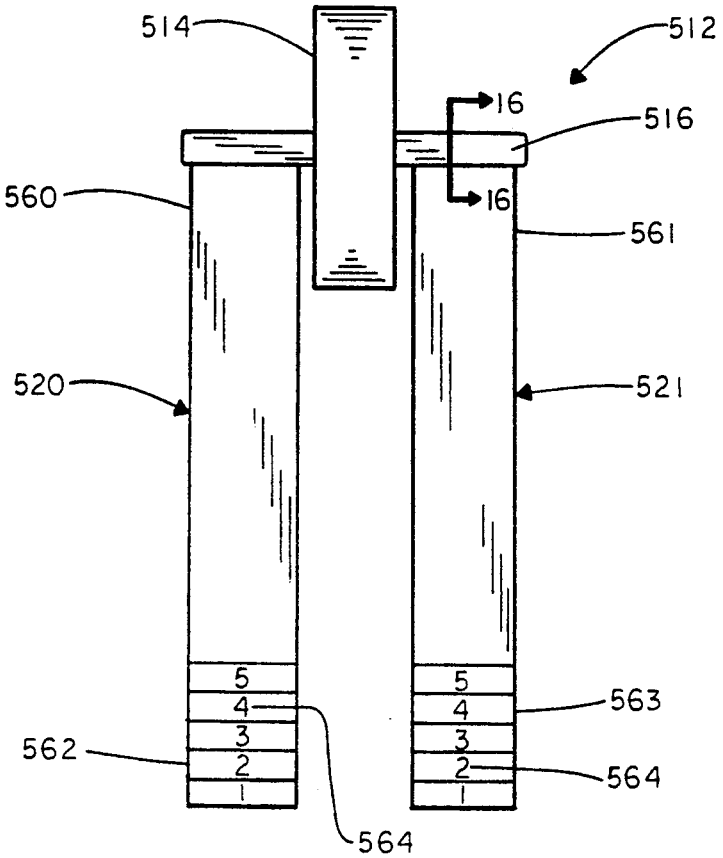
FIG. 15 is a top plan view of a sixth embodiment of the exercise device.
Figure 16:
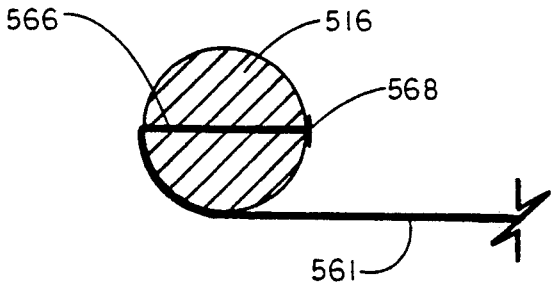
FIG. 16 is a cross-sectional view of the axle of the sixth embodiment taken along lines 16—16 of FIG. 15.

A sixth embodiment of the wheeled exercise device is seen in FIGS. 15 and 16. For the description of this embodiment, reference numerals analogous to the first embodiment are increased by 500.

The sixth embodiment of the wheeled exercise device 512 comprises a wheel 514, an axle 516, a first elastic member 520 and a second elastic member 521. As seen in FIG. 15, the first elastic member 520 is fixedly attached to the left end of the axle 516 and the second elastic member 521 is fixably attached to the right end of the axle 516.

In this embodiment, the elastic members, 520 and 521, comprise a sheet of elastic material, preferably latex rubber. One end, 560 and 561, of each of the elastic members, 520 and 521, is attached to the axle 516. One end, 560 and 561, of the elastic members, 520 and 521, is received within a diametrical slot 566 of the axle 516 on opposite sides of the wheel 514. A plug 568 is formed on the end of the elastic members 520 and 521, to retain the elastic members within the diametrical slot 566. The second end, 562 and 563, which is distal from the one end, 560 and 561, of each of the elastic members, 520 and 521, have a scale or set of graduations 564 mounted thereon which are readily visible to the user.

In operation, the user kneels on the second ends, 562 and 563, of the elastic members, 520 and 521, grasps the axle 516 and rolls the wheel 514 forward and back against the resistance supplied by the elastic members, 520 and 521. The elastic members, 520 and 521, are clamped between the user's knee and the ground or surface upon which the user is exercising. The user's weight on the elastic portions, 520 and 521, restricts movement of the elastic members 520 and 521 relative to the user's knees.

The graduations 564 on the second ends, 562 and 563, of the elastic members, 520 and 521, are useful for the user in determining where to kneel on the elastic members, 520 and 521. For example, a beginner or user who is not well conditioned would likely kneel closer to the axle 516. For example, the user could kneel on numeral 5 on the graduations 564 as seen in FIG. 15. As the user gets stronger, he could begin to move down the scale of graduations, for example, kneeling on numeral 4 or 3 of the graduations 564.

The graduations also serve to ensure that the user has his knees parallel to the axle such that the resistance supplied by the first elastic member 520 is equal to the resistance supplied by the second elastic member 521. For example, if the user places his left knee on graduation numeral 4 on the first member 520 but puts his right knee on the graduation numeral 2 on the second elastic member 521, then the resistance supplied by the first and second elastic members, 520 and 521, will differ. The graduations 564 provide an easy reference for the user to ensure that his or her knees are in the proper position.

The sixth embodiment may be further improved by mounting at least one pad on the elastic members, 520 and 521, to provide comfort for the user. Any of the pad configurations disclosed above would be suitable.

The elastic tubing disclosed in the first five embodiments discussed above, could also have graduations marked along the length thereof. As in the sixth embodiment, the graduations would provide a reference point for the user to track his progress and to ensure that the pad is positioned parallel to the axle such that equal resistance is supplied by the first and second elastic members.

Each of the six embodiments described above have described the user placing his knees on the adjustable pads. However, each of the embodiments described above can also be used by a user who places his feet on the pads. The weight of the user who places his feet on the pads will clamp the tubing such that the tubing does not move relative to the pads. By standing on the pads, a more advanced user could utilize his entire body for this exercise and stretch the tubing 20 further.

As described above, the exercise device of each of the embodiments is of a relatively simple construction, preferably incorporating primarily soft, flexible components. The design of this device and its components creates a much safer exercise device than that known previously.

While particular embodiments of the invention have been shown, it will be understood, of course, that the invention is not limited thereto since modifications may be made by those skilled in the art, particular in light of the foregoing teachings. Reasonable variation and modification are possible within the foregoing disclosure without departing from the spirit of the invention.

The embodiments of the invention in which an exclusive property or privilege is claimed are defined as follows:

1. An improved wheeled exercise device comprising at least one wheel, an axle rotatably mounted in said at least one wheel and forming handgrips for a user, the improvement comprising;

a first elastic member having two ends wherein one end is fixedly attached to said axle;

a second elastic member having two ends wherein one end is fixedly attached to said axle; and at least one pad for positioning the knees or feet of a user adjustably mounted on said first and second elastic members for selectively restricting movement of the elastic members with respect to the pad;

whereby the user can grip the handgrips, position his or her knees or feet on said at least one pad and push the wheel and axle away from said at least one pad to stretch the elastic members and wherein the positioning of said pad with respect to the tubing adjusts the exercise device for users of different size and different muscle capability.

2. An improved wheeled exercise device according to claim 1 wherein said first and second elastic members are joined together at a second end distal from said one end.

3. An improved wheeled exercised device according to claim 2 wherein said first and second elastic members are telescopically mounted on said axle.

4. An improved wheeled exercise device according to claim 2 wherein said pad comprises a first pad telescopically mounted on said first elastic member and a second pad telescopically mounted on said second elastic members.

5. An improved wheeled exercise device according to claim 1 wherein said one end of each of said first and second elastic members is telescopically mounted on said axle.

6. An improved wheeled exercise device according to claim 1 wherein said first and second elastic members are latex tubing.

7. An improved wheeled exercise device according to claim 1 wherein said pad comprises a first pad telescopically mounted on said first elastic member and a second pad telescopically mounted on said second elastic member.

8. An improved wheeled exercise device according to claim 1 wherein said pad comprises a lower member and an upper member which are interconnected by at least one hinge to clamp said first and second elastic members which pass through a channel between the lower and upper members such that the movement of the elastic members is selectively restricted with respect to said pad when the user positions his or her knees or feet on the upper member.

9. An improved wheeled exercise device according to claim 8 wherein said upper member is padded.

10. An improved wheeled exercise device according to claim 1 wherein said pad comprises a lower member and an upper member which are interconnected by at least one threaded screw which is threadably mounted in both the lower and upper members to clamp said first and second elastic members which pass through a channel between the lower and upper members such that the movement of the elastic members with respect to said pad is selectively restricted by rotation of said at least one threaded screw.

11. An improved wheeled exercise device according to claim 1 wherein handgrips are mounted on the axle on opposite sides of said at least one wheel.

12. An improved wheeled exercise device according to claim 1 further comprising a pair of end members, one of which is telescopically mounted in an end of said first elastic member and the other of said end members is telescopically mounted in an end of the second elastic member;

whereby the elastic members are fixedly attached to the axle by telescopically mounting the end members in hollow ends of the axle.

13. An improved wheeled exercise device according to claim 1 wherein said pad comprises an upper member which is mounted on top of said first and second elastic members whereby movement of the elastic members is selectively restricted with respect to said pad when the user positions his or her knees or feet on the upper member and clamps the first and second elastic members between the upper member and the ground.

14. An improved wheeled exercise device according to claim 1 wherein graduations are mounted on said first and second elastic members for positioning said at least one pad.

15. An improved wheeled exercise device comprising at least one wheel, an axle rotatably mounted on the wheel and forming a pair of handgrips for a user, the improvement comprising:

a first elastic member having two ends wherein one end is fixedly attached to said axle;

a second elastic member having two ends wherein one end is fixedly attached to said axle; and a set of graduations mounted on said first and second elastic members for positioning the knees or feet of a user;

wherein the weight of the user on said first and second elastic members selectively restricts movement of the elastic members with respect to the knees or feet of the user whereby the user can grip the handgrips, position his or her knees or feet on said graduations at different points along said first or second member and push the wheel and axle away from the user's knees or feet to stretch the first and second elastic members and wherein the positioning of the knees or feet on different graduations adjusts the exercise device for users of different size and different muscle capability.

16. An improved wheeled exercise device according to claim 15 wherein said one end of said first and second elastic members are mounted in a diametrical slot in said axle.

17. An improved wheeled exercise device according to claim 16 wherein said one end of said first and second elastic members are mounted on the axle on opposite sides of said at least one wheel.

18. An improved wheeled exercise device according to claim 16 wherein said diametrical slot is located on the axle on opposite sides of said at least one wheel.

19. An improved wheeled exercise device comprising at least one wheel, an axle rotatably mounted on said at least one wheel, and forming a pair of handgrips for a user, the improvement comprising:

a length of elastic tubing, the ends of which are telescopically mounted on said axle;

at least one pad for positioning the knees or feet of a user adjustably mounted on said elastic tubing for selectively restricting movement of the elastic tubing with respect to the pad;

whereby the user can grip the handgrips, position his or her knees or feet on said at least one pad and push the wheel and axle away from said at least one pad to stretch the elastic tubing, and wherein the positioning of said at least one pad with respect to the tubing adjusts the exercise device for users of different size and different muscle capability.

20. An improved wheeled exercise device according to claim 19 wherein said at least one pad comprises two pads telescopically mounted on said elastic tubing.

21. An improved wheeled exercise device according to claim 19 wherein graduations are mounted on said first and second elastic members for positioning said at least one pad.

22. An improved wheeled exercise device comprising at least one wheel, an axle rotatably mounted in said at least one wheel and forming handgrips for a user, the improvement comprising;

a first elastic member having two ends wherein one end is telescopically mounted on said axle;

a second elastic member having two ends wherein one end is telescopically mounted on said axle;

whereby the user can grip the handgrips, position his or her knees or feet on the tubing to selectively restrict movement of the elastic members with respect to his or her knees or feet and push the wheel and axle away from his or her knees and feet to stretch the elastic members.

23. An improved wheeled exercise device according to claim 22 wherein said first and second elastic members are joined together at a second end distal from said one end.

24. An improved wheeled exercise device according to claim 23 further comprising at least one pad adjustably mounted on said first and second elastic members for positioning of the knees or feet of a user to selectively restrict movement of the elastic members with respect to the pad.

25. An improved wheeled exercise device according to claim 22 further comprising at least one pad adjustably mounted on said first and second elastic members for positioning of the knees or feet of a user to selectively restrict movement of the elastic members with respect to the pad.

26. An improved wheeled exercise device according to claim 22 wherein said first and elastic members are latex tubing.

* * * * *